US006640991B1

(12) United States Patent
Amanat et al.

(10) Patent No.: US 6,640,991 B1
(45) Date of Patent: Nov. 4, 2003

(54) METHODS AND APPARATUS FOR MINIMIZING WASTE DISPOSAL SPACE

(75) Inventors: Alex H. Amanat, Wildwood, MO (US); Paul H. Wunderlich, Chesterfield, MO (US)

(73) Assignee: Minimizim LLC, Chesterfield, MI (US)

( * ) Notice: Subject to any disclaimer, the term of this patent is extended or adjusted under 35 U.S.C. 154(b) by 0 days.

(21) Appl. No.: 09/489,723

(22) Filed: Jan. 24, 2000

(51) Int. Cl.[7] ..... A47G 19/00
(52) U.S. Cl. ..... 220/574; 220/7
(58) Field of Search ..... 220/6, 574, 575, 220/7; 229/77, 78.1, 78.2

(56) References Cited

U.S. PATENT DOCUMENTS 389,318 A * 9/1888 Oliver ..... 229/77
657,018 A * 8/1900 Trenchard, Jr. ..... 229/77
726,205 A * 4/1903 Tuttle
828,847 A * 8/1906 Gorman ..... 229/77
984,482 A * 2/1911 Howell ..... 229/77
1,131,135 A * 3/1915 Hudson
1,306,378 A * 6/1919 Hogan ..... 229/77
1,619,215 A * 3/1927 Olgay ..... 229/77
1,668,372 A * 1/1928 Kleebauer et al. ..... 229/77
2,374,798 A * 5/1945 Berkowitz ..... 229/77
3,067,927 A * 12/1962 Eisemann, Jr.
3,281,061 A * 10/1966 Lum
3,750,938 A * 8/1973 Wiseman
5,810,194 A * 9/1998 Samsel

* cited by examiner

*Primary Examiner*—Mickey Yu
*Assistant Examiner*—Troy Arnold
(74) *Attorney, Agent, or Firm*—Robert B. Resser, III; Armstrong Teasdale LLP

(57) ABSTRACT

A receptacle is fabricated to be folded prior to disposal to minimize waste disposal space. The receptacle includes a first portion including a plurality of fold lines and having a first surface area. The fold lines permit the receptacle to be folded prior to disposal such that the first portion has a second surface area. A fastening mechanism is attached to the receptacle on the first portion. The fold lines are formed to fold the receptacle such that the fastening mechanism maintains the receptacle in a folded position for disposal.

6 Claims, 4 Drawing Sheets

METHODS AND APPARATUS FOR MINIMIZING WASTE DISPOSAL SPACE

BACKGROUND OF THE INVENTION

This application relates generally to receptacles and, more particularly, to receptacles which include fastening mechanisms.

Every year vast sums of money and resources are used to dispose large quantities of waste and to educate the population on potential waste disposal problems. However, waste disposal is an increasing problem since waste continues to be produced in large quantities. Common household goods that have a large volume or a large surface area when disposed contribute to the problem. For example, discarding only a few disposable plates into a trash receptacle may quickly fill the trash receptacle depending on the positions of the plates when placed within the trash receptacle. Additionally, discarding only a few common cartons, such as tissue boxes or cereal boxes, may also quickly fill the trash receptacle while wasting valuable waste disposal space.

To minimize the effect of the waste, rubbish compressing apparatuses compress the waste to a small volume prior to its disposal. Such apparatuses are expensive and require a power source. As a result, such apparatuses are not feasible for use when disposing of rubbish outdoors, such as after a picnic, a fair, or a camping excursion. Additionally, to effectively utilize such an apparatus, the waste must first be sorted to prevent damage to the apparatus. Furthermore, even after sorting, depending on the position of the rubbish during the compacting operation of the apparatus, those goods having a large surface area may not be compressed prior to disposal. As a result, waste disposal costs remain high and waste disposal space continues to be wasted.

BRIEF SUMMARY OF THE INVENTION

In an exemplary embodiment, a receptacle is fabricated to be folded to minimize waste disposal space. The receptacle includes a first portion including a plurality of fold lines and having a first surface area. The fold lines permit the receptacle to be folded prior to disposal such that the first portion has a second surface area. A fastening mechanism is attached to the receptacle on the first portion. The fold lines are formed to permit the receptacle to be folded such that the fastening mechanism fastens to maintain the receptacle in a folded position for disposal. As a result, waste disposal space in local trash receptacles and in landfills is conserved.

DETAILED DESCRIPTION OF THE INVENTION

Figure 1:
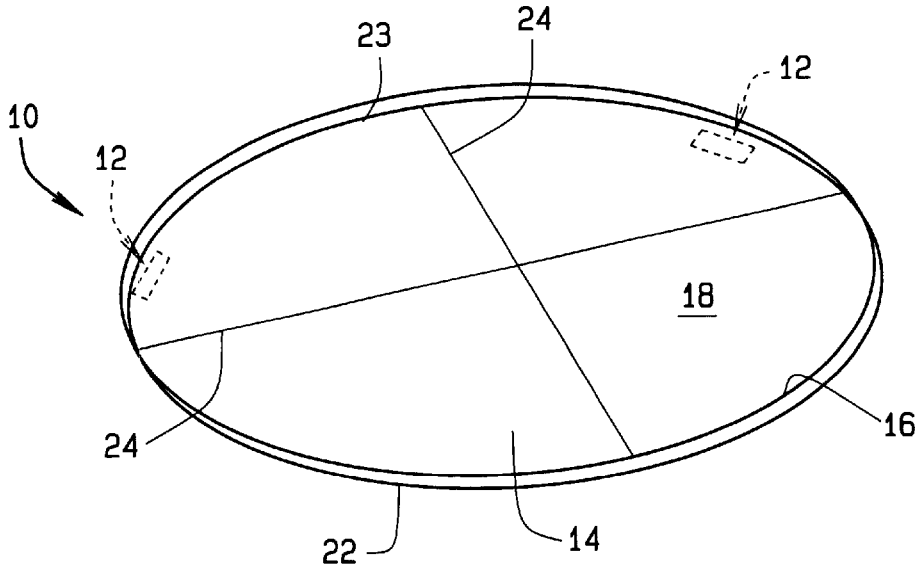
FIG. 1 is top perspective view of a receptacle including a fastening mechanism.
Figure 2:
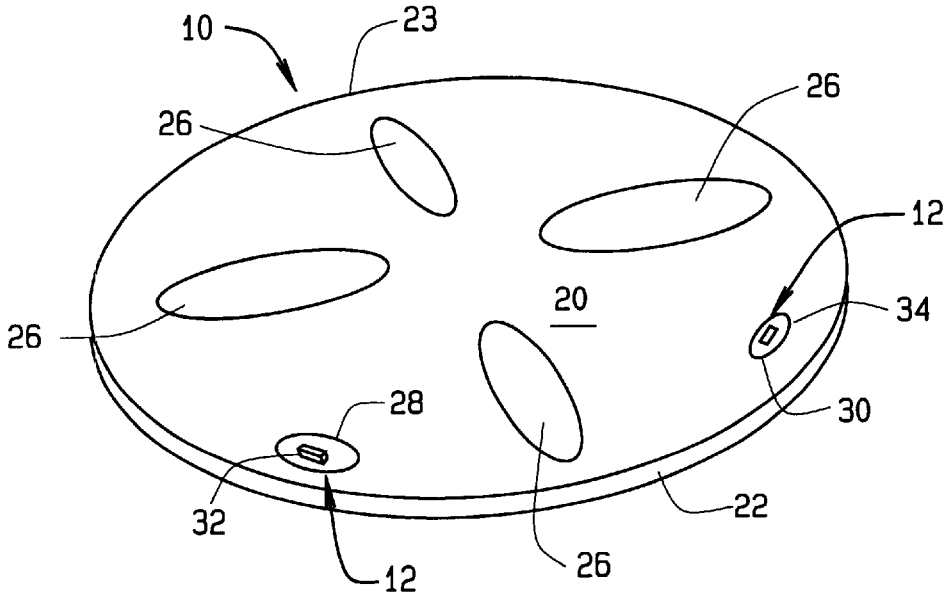
FIG. 2 is a bottom perspective view of the receptacle shown in FIG. 1.

FIG. 1 is top perspective view of a receptacle 10 including a fastening mechanism 12 and a first portion 14. FIG. 2 is a bottom perspective view of receptacle 10. First portion 14 is circular and includes an outer border 16, a top surface 18, and a bottom surface 20. Top surface 18 is substantially planar and is bounded by a perimeter 22. Perimeter 22 extends circumferentially from an outer periphery 23 of top surface 18 to outer border 16. Outer periphery 23 circumscribes first portion 14 and defines a first surface area for first portion 14. In one embodiment, receptacle 10 accommodates food products and is a plate.

First portion 14 also includes a plurality of fold lines 24. In one embodiment, first portion 14 includes two fold lines 24. Alternatively, first portion 14 includes more than two fold lines 24. Fold lines 24 extend across first portion top surface 18 and permit receptacle 10 to be folded prior to receptacle 10 being disposed.

In one embodiment, fold lines 24 extend through perimeter 22 to outer border 16 and permit receptacle 10 to be folded in quarters. Fold lines 24 are stamped on receptacle first portion top surface 18 and are easily visible on first portion top surface. Alternatively, fold lines 24 are machined, embossed, or molded with receptacle 10. In one embodiment, first portion bottom surface 20 is reinforced in areas 26 corresponding to areas in which fold lines 24 extend across first portion top surface 18.

Fold lines 24 are formed such that when receptacle 10 is used, the structural integrity of receptacle 10 is maintained to prevent inadvertent folding of receptacle 10. Additionally, fold lines 24 are fabricated such that when receptacle 10 is disposed, fold lines 24 permit receptacle 10 to be folded such that first portion 14 has a second surface area and such that fastening mechanism 12 is aligned. In one embodiment, fold lines 24 are color-coded to be more visible. In another embodiment, receptacle 10 includes arrows to indicate directions receptacle 10 should be folded for disposal.

Fastening mechanism 12 is attached to receptacle first portion bottom surface 20 with an adhesive material. Alternatively, fastening mechanism 12 is integrally formed with receptacle first portion bottom surface 20. First portion bottom surface 20 is reinforced in areas 28 and 30 surrounding fastening mechanism 12 to provide additional structural support to receptacle 10. Fastening mechanism 12 includes a male half 30 and a female half 32. Fastening mechanism female half 32 is sized to receive fastening. mechanism male half 30. Alternatively, fastening mechanism male half 30 is removably attached to fastening mechanism female half 32. In one embodiment, receptacle 10 includes a plurality of fastening mechanisms 12 and each fastening mechanism 12 is color-coded.

Fastening mechanism 12 is attached to first portion bottom surface 20 in close proximity to first portion top surface outer periphery 23. Fold lines 24 are formed such that after receptacle 10 is folded, fastening mechanism male half 30 is aligned to engage fastening mechanism female half 32 to maintain receptacle 10 in a folded position (not shown in FIGS. 1 or 2).

Figure 3:
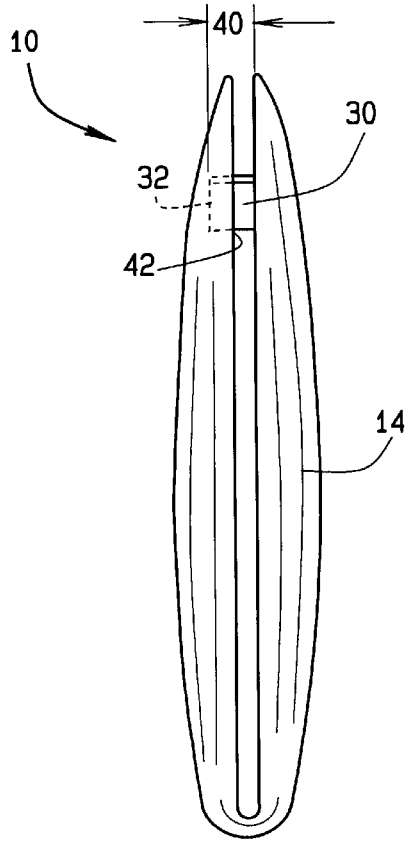
FIG. 3 is a side view of the receptacle shown in FIG. 1 folded for disposal.

FIG. 3 is a side view of receptacle 10 folded for disposal. Receptacle fold lines 24 (shown in FIG. 1) permit receptacle 10 to be folded such that receptacle first portion 14 has a second surface area. In one embodiment, the second surface area of receptacle first portion 14 is smaller than the first surface area of receptacle first portion 14. Receptacle fold lines 24 are formed such that when receptacle 10 is in a folded position, as shown in FIG. 3, fastening mechanism male portion 30 is aligned to engage fastening mechanism female portion 32 to maintain receptacle 10 in the folded position for disposal.

Fastening mechanism male portion 30 extends from receptacle first portion bottom surface 20 a distance 40. Fastening mechanism female portion 32 includes an opening 42 sized to receive and engage fastening mechanism male portion 30 such that receptacle 10 is maintained in a folded position for disposal. In one embodiment, fastening mechanism 12 is a snap fitting mechanism. Alternatively, any other suitable fastening device or retaining device may be used which maintains receptacle 10 in a folded condition for disposal, including, but not limited to mechanical devices, interlocking devices, hook and pile fasteners, hook and loop fasteners, tab and slot devices, locking mechanisms, magnets, tying systems, or clips.

Figure 4:
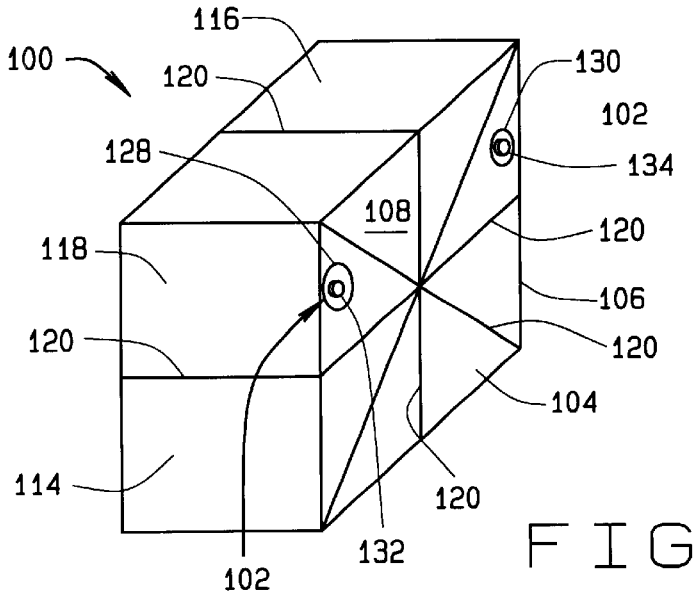
FIG. 4 is a perspective view of an alternative embodiment of a receptacle including a fastening mechanism.
Figure 5:
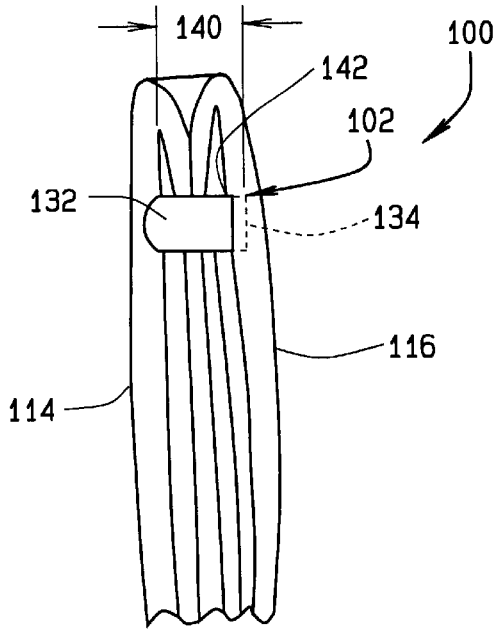
FIG. 5 is a side view of the receptacle shown in FIG. 4 folded for disposal.

FIG. 4 is a perspective view of a receptacle 100 including a fastening mechanism 102 and a base 104. FIG. 5 is a side view of receptacle 100 folded for disposal. In one embodiment, receptacle 100 accommodates food products, such as cereal. Alternatively, receptacle 100 accommodates non-edible products, such as tissues. Base 104 is substantially planar and has a substantially rectangular profile. Base 104 includes a perimeter 106, an outer surface 108, and an inner surface (not shown). Perimeter 106 circumscribes base 104 and defines a first surface area for base 104. Receptacle 100 includes a left side 112, a right side 114, a front side 116, and a back side (not shown). A side wall 118 extends substantially perpendicularly from base perimeter 106 to a top (not shown). Side wall 118 extends between receptacle base 104 and a receptacle top (not shown).

Base 104 is constructed substantially similarly with the receptacle top, and both the top and base 104 also include a plurality of fold lines 120. In one embodiment, base 104 includes three fold lines 120. Fold lines 120 extend across base outer surface 108 from receptacle left side 112 to receptacle right side 114, and from the receptacle back side to receptacle front side 116 to permit receptacle 100 to be folded prior to being disposed. Fold lines 120 also extend across side wall 118 between base 104 and the receptacle top. In alternative embodiments, fold lines 120 extend in a plurality of directions across side wall 118. Fold lines 24 are stamped on receptacle base 104 and are easily visible on base outer surface 108. In alternative embodiments, fold lines 120 are machined, embossed, or molded to receptacle 100.

Fold lines 120 are formed such that when receptacle 100 is used, the structural integrity of receptacle 100 is maintained to prevent inadvertent folding of receptacle 100. Additionally, fold lines 120 are formed such that when receptacle 100 is to be disposed, fold lines 120 permit receptacle 100 to be folded such that receptacle base 100 has a second surface area and such that fastening mechanism 102 is aligned. In one embodiment, fold lines 120 are color-coded to be more visible. In another embodiment, receptacle 100 includes arrows to indicate directions receptacle 100 should be folded for disposal.

Fastening mechanism 102 is attached to receptacle base outer surface 108 with an adhesive material. An additional fastening mechanism 102 is attached to an outer surface (not shown) of the receptacle top. Alternatively, fastening mechanism 102 is integrally fabricated with receptacle base outer surface 108 and the receptacle top outer surface. Base outer-surface 108 is reinforced in areas 128 and 130 surrounding fastening mechanism 102 to provide additional structural support to receptacle 100. Fastening mechanism 102 includes a male half 132 and a female half 134. Fastening mechanism female half 134 is sized to receive fastening mechanism male half 132. Alternatively, fastening mechanism male half 132 is removably attached to fastening mechanism female half 134. In one embodiment, receptacle 100 includes a plurality of fastening mechanisms 102 and each fastening mechanism 102 is color-coded.

Fastening mechanism 12 is attached to base bottom surface 20 in close proximity to receptacle side walls 118. Fold lines 120 are formed such that after receptacle 100 is folded, fastening mechanism male half 132 is aligned to engage fastening mechanism female half 134 to maintain receptacle 100 in a folded position. Fold lines 120 are also formed such that after receptacle 100 is folded, receptacle base 104 has a second surface area. In one embodiment, the second surface area of receptacle base 104 is smaller than the first surface area of receptacle base 104. Receptacle fold lines 120 are formed such that when receptacle 100 is in a folded position, as shown in FIG. 5, fastening mechanism male portion 132 is aligned to engage fastening mechanism female portion 134 to maintain receptacle 100 in the folded position for disposal.

Fastening mechanism male portion 132 extends from receptacle base outer surface 108 a distance 140. Fastening mechanism female portion 134 includes an opening 142 sized to receive fastening mechanism male portion 132 such that receptacle 100 is maintained in a folded position for disposal. In one embodiment, fastening mechanism 102 is a snap fitting mechanism. Alternatively, any other suitable fastening device or retaining device may be used which maintains receptacle 100 in a folded condition for disposal, including, but not limited to mechanical devices, interlocking devices, hook and pile fasteners, hook and loop fasteners, tab and slot devices, locking mechanisms, magnets, tying systems, or clips.

Figure 6:
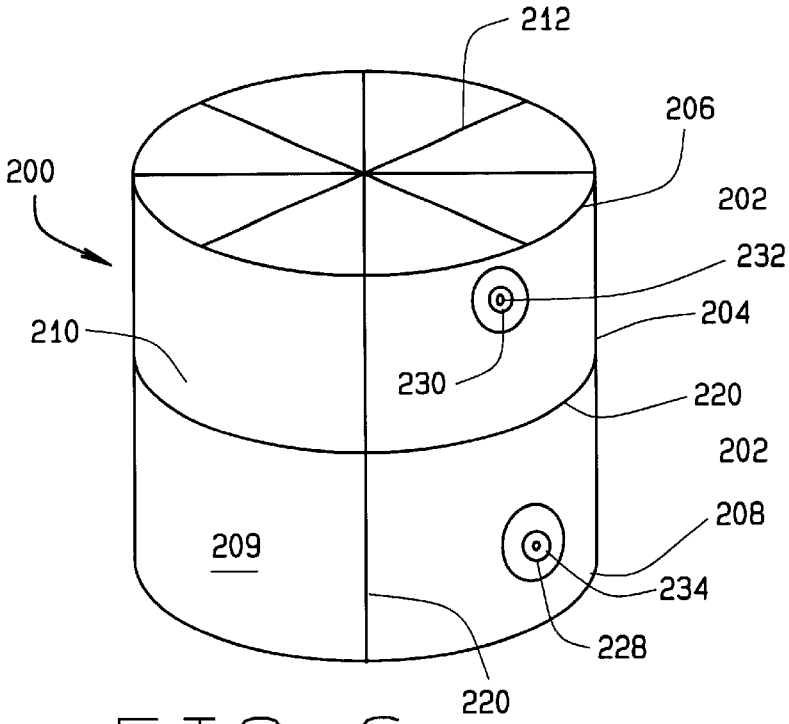
FIG. 6 is a perspective view of another alternative embodiment of a receptacle including a fastening mechanism.
Figure 7:
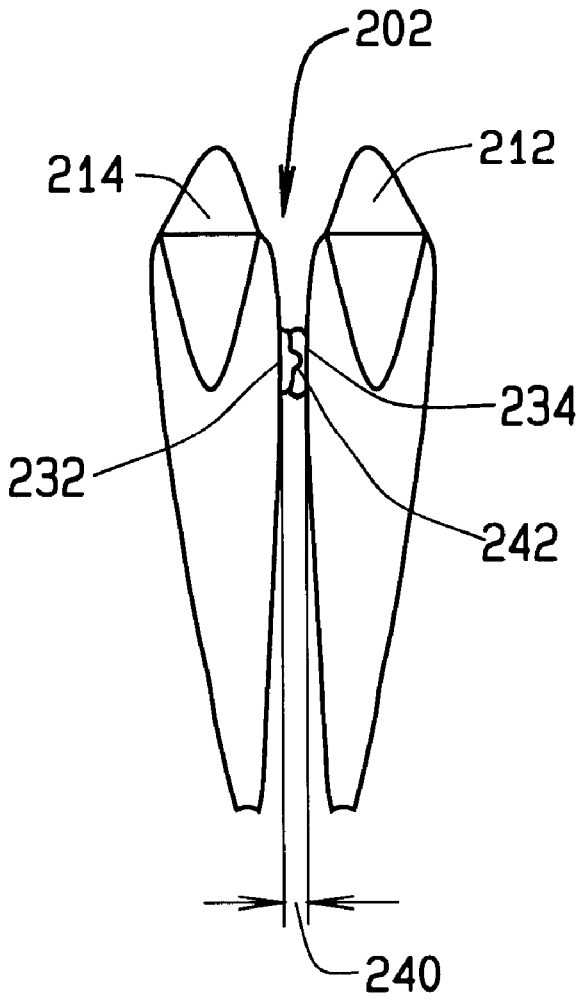
FIG. 7 is a view of the receptacle shown in FIG. 6 folded for disposal.

FIG. 6 is a perspective view of a receptacle 200 including a fastening mechanism 202 and a side wall 204. FIG. 7 is a side view of receptacle 200 folded for disposal. In one embodiment, receptacle 200 accommodates food products, such as oatmeal. Alternatively, receptacle 200 accommodates non-edible products. Side wall 204 is annular and has a substantially circular cross-sectional profile. Side wall 204 includes an upper edge 206, a lower edge 208, a body 210 extending between upper edge 206 and lower edge 208, and an outer surface 209. Upper edge 208 circumscribes a top 212 and lower edge 210 circumscribes a bottom 214. Side wall 204 has a first surface area extending between receptacle top 212 and receptacle bottom 214. Receptacle top 212 and receptacle bottom 214 are each substantially perpendicular to side wall 204.

Side wall 204 includes a plurality of fold lines 220 to permit receptacle 200 to be folded prior to disposal. Fold lines 220 extend along side wall outer surface 209 between receptacle top 212 and receptacle bottom 214, and circumferentially around receptacle 200 along side wall outer surface 209. Fold lines 220 also extend across receptacle top 212 and the receptacle bottom. Fold lines 220 are stamped on receptacle 200. In alternative embodiments, fold lines 220 are machined, embossed, or molded to receptacle 200.

Fold lines 220 are formed such that when receptacle 200 is used, receptacle 200 maintains its structural integrity to prevent inadvertent folding of receptacle 200. Additionally, fold lines 220 are fabricated such that when receptacle 200 is to be disposed, fold lines 220 permit receptacle 200 to be folded such that receptacle side wall 204 has a second surface area and such that fastening mechanism 202 is aligned. In one embodiment, fold lines 220 are color-coded to be more visible. In another embodiment, receptacle 200 includes arrows to indicate directions receptacle 200 should be folded for disposal.

Fastening mechanism 202 is attached to receptacle side wall outer surface 209 with an adhesive material. Alternatively, fastening mechanism 202 is integrally fabricated with side wall outer surface 209. Side wall outer surface 209 is reinforced in areas 228 and 230 surrounding fastening mechanism 202 to provide additional structural support to receptacle 200. Fastening mechanism 202 includes a male half 232 and a female half 234. Fastening mechanism female half 234 is sized to receive fastening mechanism male half 232. Alternatively, male half 232 is removably attached to female half 234. In one embodiment, receptacle 200 includes a plurality of fastening mechanisms 202 and each fastening mechanism 202 is colorcoded.

Fastening mechanism 202 is attached to side wall outer surface 209 in close proximity to upper and lower edges 206 and 208. Fold lines 220 are formed such that after receptacle 200 is folded, fastening mechanism male half 232 is aligned to engage fastening mechanism female half 234 to maintain receptacle 200 in a folded position. Fold lines 220 are also formed such that after receptacle 100 is folded, receptacle side wall 204 has a second surface area. In one embodiment, the second surface area of receptacle side wall 204 is smaller than the first surface area of receptacle side wall 204. Receptacle fold lines 220 are formed such that when receptacle 200 is in a folded position, as shown in FIG. 7, fastening mechanism male portion 232 is aligned to engage fastening mechanism female portion 234 to maintain receptacle 200 in the folded position for disposal.

Fastening mechanism male portion 232 extends from receptacle side wall outer surface 209 a distance 240. Fastening mechanism female portion 234 includes an opening 242 sized to receive fastening mechanism male portion 232 such that receptacle 200 is maintained in a folded position for disposal. In one embodiment, fastening mechanism 202 is a snap fitting mechanism. Alternatively, any other suitable fastening device or retaining device may be used which maintains receptacle 200 in a folded condition for disposal, including, but not limited to mechanical devices, hook and pile fasteners, hook and loop fasteners, tab and slot devices, locking mechanisms, magnets, tying systems, or clips.

Receptacles 10, 100, and 200 include fold lines 24, 120, and 220, respectively, which permit receptacles 10, 100, and 200 to be folded prior to disposal and each receptacles' fastening mechanism 12, 102, and 202, respectively, maintains the folded position of each receptacle 10, 100, and 200 for disposal. Accordingly, the folded position of each receptacle 10, 100, and 200 reduces an amount of waste disposal space utilized by each receptacle 10, 100, and 200 in local trash receptacles and in landfills. In one embodiment, receptacles 10, 100, and 200 are used by bulk shippers including, but not limited to, food preparers, grocers, shippers, wholesalers, and similar other professions, to minimize disposal space following shipments of large quantities of items or bulk goods. In another embodiment, receptacles 10, 100, and 200 are used by food preparers including, but not limited to, hospitals, hotels, schools, and restaurants forced to serve food on disposable receptacles when dish washing facilities are not available. In a further embodiment, because receptacles 10, 100, and 200 are folded, any food remaining on receptacles 10, 100, and 200 is contained in the folded receptacle, receptacles 10, 100, and 200 are used to increase hygienic practices by organizations including, but not limited to, disaster and emergency relief agencies and the military. In another embodiment, receptacles 10, 100, and 200 are used to facilitate clean-up practices by organizations at sites including, but not limited to, national parks, entertainment parks, sporting arenas, picnic areas, and concert venues. In yet another embodiment, receptacles 10, 100, and 200 are used in areas having limited disposal space or means including, but not limited to, automobiles, trains, planes, and buses.

The above described receptacle is cost-effective and reliable. Each receptacle includes a plurality of fold lines and a fastening mechanism. The fold lines permit the receptacle to be folded prior to disposal. When discarded, the fastening mechanism maintains the receptacle in a folded position, thus limiting an amount of waste disposal space occupied by the receptacle within the trash receptacle. As a result, land fill space and waste disposal space is conserved.

While the invention has been described in terms of various specific embodiments, those skilled in the art will recognize that the invention can be practiced with modification within the spirit and scope of the claims.

What is claimed is:

1. A disposable plate comprising:

a first surface comprising at least one fold line; and a second surface opposite said first surface, one of said first surface and said second surface comprising a fastening mechanism comprising a first fastener and a second fastener, said plate foldable at least in half along said at least one fold line such that said first fastener engages said second fastener for maintaining said plate in a folded condition, said second surface reinforced along said at least one fold line.

2. A plate in accordance with claim 1 wherein said first surface comprises a plurality of fold lines.

3. A plate in accordance with claim 1 wherein said first surface comprises a plurality of fold lines, said plate configured to be folded at least twice, such that said first fastener engages said second fastener for maintaining said plate in a folded condition.

4. A plate in accordance with claim 1 wherein said first surface comprises a plurality of fold lines, said plate configured to be folded in quarters.

5. A plate in accordance with claim 1 wherein said plate fold line is stamped into said first surface.

6. A plate in accordance with claim 1 wherein said fastening mechanism is formed integrally with said plate.

* * * * *

UNITED STATES PATENT AND TRADEMARK OFFICE

CERTIFICATE OF CORRECTION

PATENT NO. : 6,640,991 B1
DATED : November 4, 2003
INVENTOR(S) : Amanat et al.

It is certified that error appears in the above-identified patent and that said Letters Patent is hereby corrected as shown below:

Title page,
Item [73], Assignee, delete "Chesterfield, MI (US)" and insert therefor
-- Chesterfield, MO (US) --.

Signed and Sealed this

Thirtieth Day of March, 2004

JON W. DUDAS
*Acting Director of the United States Patent and Trademark Office*